US005176120A

United States Patent [19]

Takahashi

[11] Patent Number: 5,176,120

[45] Date of Patent: Jan. 5, 1993

[54] FUEL INJECTOR

[75] Inventor: Takeshi Takahashi, Mishima, Japan

[73] Assignee: Toyota Jidosha Kabushiki Kaisha, Toyota, Japan

[21] Appl. No.: 705,317

[22] Filed: May 24, 1991

[30] Foreign Application Priority Data

May 29, 1990 [JP] Japan ..... 2-137237

[51] Int. Cl.[5] ..... F02M 37/04

[52] U.S. Cl. ..... 123/467; 123/447; 123/446

[58] Field of Search ..... 123/467, 447, 458, 506, 123/446

[56] References Cited

U.S. PATENT DOCUMENTS

| | | | |
|---|---|---|---|
| 4,545,352 | 10/1985 | Jourde | 123/467 |
| 4,566,416 | 1/1986 | Berchtold | 123/458 |
| 4,719,889 | 1/1988 | Amann | 123/467 |
| 5,012,786 | 5/1991 | Voss | 123/467 |

FOREIGN PATENT DOCUMENTS

| | | | |
|---|---|---|---|
| 240353 | 10/1987 | European Pat. Off. | 123/467 |
| 367114 | 5/1990 | European Pat. Off. | 123/467 |
| 393590 | 10/1990 | European Pat. Off. | 123/467 |
| 55-23375 | 2/1980 | Japan . | |
| 56-39863 | 4/1981 | Japan . | |
| 59-83065 | 10/1984 | Japan . | |
| 0085168 | 4/1987 | Japan | 123/447 |
| 01114979 | 1/1988 | Japan | 123/467 |
| 1-114979 | 8/1989 | Japan . | |
| 0275058 | 11/1990 | Japan | 123/447 |

OTHER PUBLICATIONS

Patent Abstracts of Japan, Fuel Injection System for Internal Combustion Engine, Sep. 19, 1989, vol. 12, No. 420 (M-872) (3768).

*Primary Examiner*—Carl S. Miller

*Attorney, Agent, or Firm*—Kenyon & Kenyon

[57] ABSTRACT

A fuel injector comprising a restricted opening arranged between the pressure chamber and the pressure control chamber, a check valve for permitting fuel to flow only from the pressure control chamber to the pressure chamber, and an opening and closing valve opening when the fuel pressure in the pressure control chamber becomes lower than the fuel pressure in the pressure chamber, by a predetermined pressure. The restricted opening, the check valve and the opening and closing valve are arranged in parallel to each other, and by controlling the fuel pressure in the pressure control chamber by a fuel pressure control unit, a first pattern in which the fuel injection rate is gradually raised, and a second pattern in which the fuel injection rate is quickly raised, can be obtained.

12 Claims, 4 Drawing Sheets

FUEL INJECTOR

BACKGROUND OF THE INVENTION

1. Field of the Invention

The present invention relates to a fuel injector.

2. Description of the Related Art

A fuel injector which is opened by moving a needle with the aid of a fuel pressure in a high pressure passageway, wherein a pressure chamber defined by the rear surface of the needle and connected to the high pressure passageway is formed in the fuel injector and a restricted opening and a check valve are arranged such that fuel easily flows in the region between the pressure chamber and the high pressure passageway but the flow out of fuel from the pressure chamber is restricted to thus raise the fuel injection pressure and maintain a good fuel injection completion is known (see Japanese Unexamined Utility Model Publication No. 1-114979).

When a large quantity of fuel is supplied into each combustion chamber of a diesel engine, to be burnt therein, the fuel is quickly burnt upon the ignition thereof. Accordingly, the combustion pressure is quickly raised, and this results in a generation of noise. To prevent a sudden rise of the combustion pressure when the fuel is ignited, the ignition should occur when only a small quantity of fuel exists in each combustion chamber, the quantity of fuel to be supplied into the combustion chamber gradually increased thereafter, and the increased quantity of fuel successively burnt to thereby gradually raise the combustion pressure. Therefore, preferably a fuel injection rate of fuel from the fuel injector is gradually increased. Namely, the fuel injection rate is gradually increased with an elapse of time from the time at which the fuel injection is started. Further, when the engine operates at a high engine speed with a large torque at an engine shaft, preferably the fuel injection rate is quickly raised because a large quantity of fuel must be supplied to each combustion chamber a short time. Namely, preferably the raising of the fuel injection rate is varied in accordance with the current running state of the engine.

With the conventional fuel injector as described above, however, since a pattern representing the fuel injection rate is based on a diameter of the restricted opening, a problem arises in that the fuel injection rate pattern cannot be varied to a desired fuel injection rate pattern corresponding to the current running state of the engine.

SUMMARY OF THE INVENTION

The present invention has been created in consideration of the above problems.

Therefore, an object of the present invention is to provide a fuel injector by which a pattern representing a fuel injection rate can be changed to a desired fuel injection rate pattern corresponding to the current running state of an engine.

Therefore, according to the present invention, there is provided a fuel injector including a needle and a pressure chamber defined by the rear surface of the needle, the needle being closed when a fuel pressure in the pressure chamber is high and being open when the fuel pressure in the pressure chamber is low, the fuel injector comprising: a pressure control chamber formed in the region adjacent to the pressure chamber; a restricted opening arranged between the pressure chamber and the pressure control chamber; a check valve for permitting fuel to flow only in the direction from the pressure control chamber toward the pressure chamber; an opening and closing valve opening when the fuel pressure in the pressure control chamber becomes lower than the fuel pressure in the pressure chamber by a predetermined first pressure, the restricted opening, the check valve and the opening and closing valve being arranged in parallel to each other; and fuel pressure controlling means for controlling a fuel pressure in the pressure control chamber, the fuel pressure controlling means raising the fuel pressure in the pressure control chamber to introduce fuel in the pressure control chamber into the pressure chamber via the check valve, the fuel pressure controlling means lowering the fuel pressure in the pressure control chamber to discharge fuel in the pressure chamber into the pressure control chamber via the restricted opening when the fuel pressure in the pressure chamber is lower than a predetermined second pressure and to discharge the fuel in the pressure chamber into the pressure control chamber via the opening and closing valve when the fuel pressure in the pressure chamber is higher than the predetermined second pressure.

The present invention may be more fully understood from the description of a preferred embodiment of the invention set forth below, together with the accompanying drawings.

BRIEF DESCRIPTION OF THE DRAWINGS

The present invention is illustrated in the following drawings in which.

DESCRIPTION OF A PREFERRED EMBODIMENT

The present invention will be described in detail hereinafter with reference to the accompanying drawings, which illustrate a preferred embodiment of the present invention.

Figure 1:
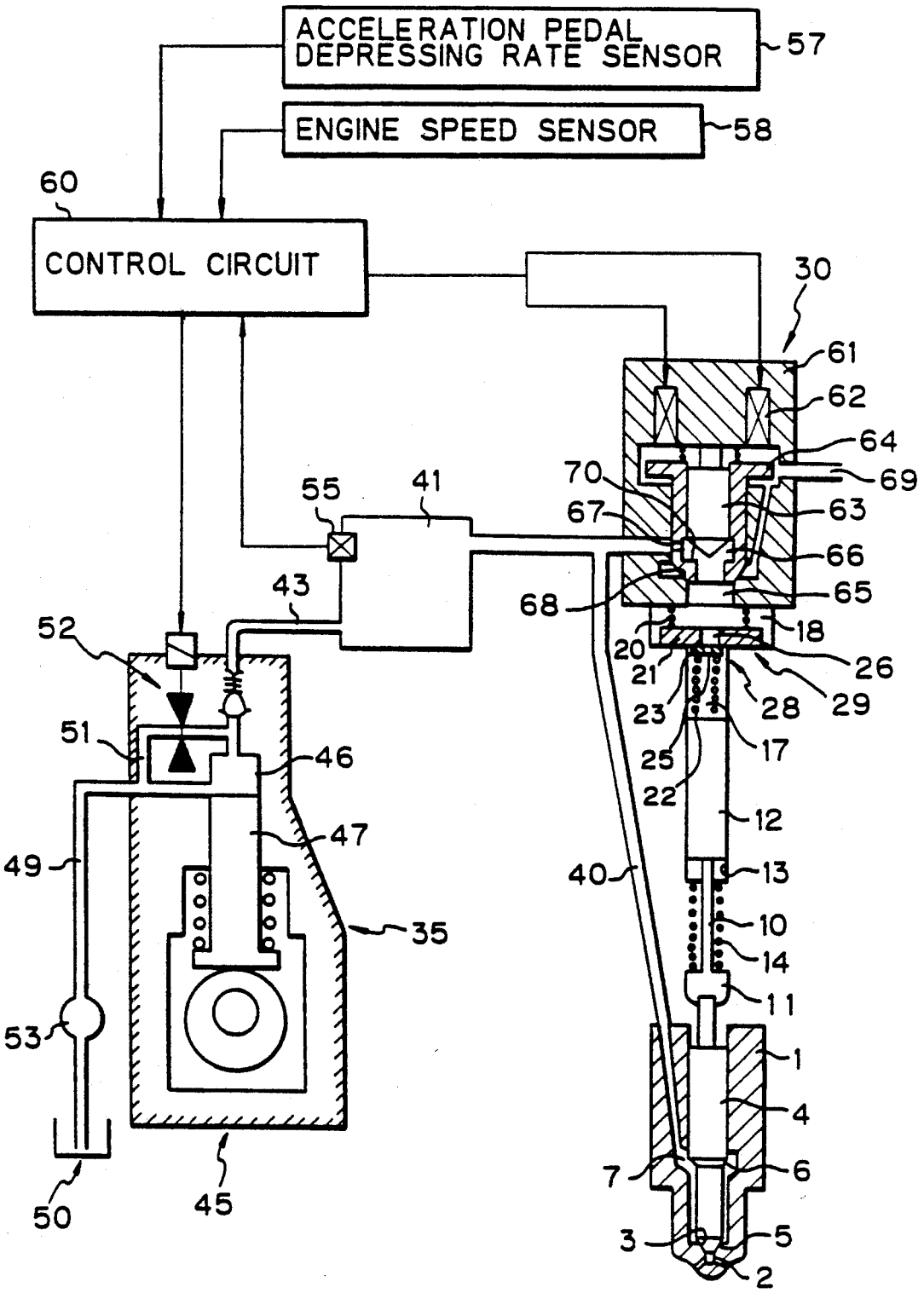
FIG. 1 is a schematic view of a fuel injector system in accordance with an embodiment of the present invention.

Referring to FIG. 1, a nozzle main body 1 is formed with a single nozzle 2 or a plurality of nozzles 2 and a nozzle seat 3; a needle 4 is slidably received in the nozzle main body 1 to slidably move in the axial direction, and a valve portion 5 and a pressure receiving portion 6 are formed on the needle 4; and a fuel pressure in a fuel chamber 7 formed between the needle body 1 and the needle 4 is exerted on the pressure receiving portion 6. As apparent from the drawing, the fuel chamber 7 is communicated with a common rail 41 via a fuel passageway 40.

A rod 10 is connected to the rear surface of the needle 4 and a piston 12 is connected to the upper end of the rod 10, and the piston 12 is slidably received in a cylinder 13 which is formed in the nozzle main body 1. A spring holding portion 11 is formed on the rod 10 such that a compression spring 14 is mounted on the spring holding portion 11 so as to allow the needle 4 to be normally biased in the valve-closing direction.

A pressure chamber 17 is formed on the rear surface side of the piston 12 and a pressure control chamber 18 is arranged in the region adjacent to the pressure chamber 17. According to the embodiment of the present invention shown in FIG. 1, the pressure chamber 17 is communicated with the pressure control chamber 18 at the central part of the bottom wall of the pressure control chamber 18. A valve disc 21 is received in the pressure control chamber 18 so that it is normally brought into close contact with the bottom wall surface of the pressure control chamber 18 by the resilient force of a compression spring 20. When the valve disc 21 is located on the bottom wall surface of the pressure control chamber 18 in the above-described manner, an aperture of the pressure chamber 17 is closed with the valve disc 21. A through hole 26 is formed in the valve disc 21, and an orifice valve disc 23 is disposed in the pressure chamber 17 such that the orifice valve disc 23 is biased toward the valve disc 21 by a compression spring 22. The through hole 26 is normally closed with the orifice valve disc 23. A restricted opening 25 is formed at the central part of the orifice valve disc 23 in alignment with the through hole 26.

As apparent from FIG. 1, the through hole 26, the orifice valve disc 23 and the compression spring 22 constitute a check valve 28 which permits fuel to flow only from the pressure control chamber 18 toward the pressure chamber 17. On the other hand, the valve disc 21 and the compression spring 20 constitute an opening and closing valve 29 which is opened when the fuel pressure in the pressure control chamber 18 becomes lower than the fuel pressure in the pressure chamber 17 by a predetermined first pressure. The pressure required for opening the opening and closing valve 29 is determined depending on the resilient force of the compression spring 20, for example, the pressure is set to about 550 kg/cm$^2$.

As shown in FIG. 1, the restricted opening 25, the check valve 28 and the opening and closing valve 29 are arranged in series to each other from the viewpoint of structure, but are practically arranged in parallel to each other from the viewpoint of function. Therefore, a parallel arrangement of the aforementioned components from the viewpoint of function is referred to as "arranged in parallel to each other" throughout the specification.

A fuel pressure in the pressure control chamber 18 is controlled by a fuel pressure control unit 35, which comprises a fuel injection pump 45 and a solenoid valve 30.

The solenoid valve 30 is composed of an exciting coil 62 disposed in a casing 61, a stator 63 and a movable valve disc 64 slidably disposed in the stator 63 to move slidably relative to the stator 63. While the coil 62 is turned off, the movable valve disc 64 is held at the position as shown in FIG. 1, and at this time, the movable valve disc 64 is brought into close contact with a valve seat 68, to thereby isolate an atmosphere communication passageway 69 leading to an environmental atmosphere from the pressure control chamber 18. At this time, the pressure control chamber 18 is communicated with a fuel passageway 40 via a passageway 65 in the casing 61, a passageway 66 in the movable valve disc 64, and a communication hole 67 formed on the peripheral wall of the movable valve disc 64. On the other hand, when the coil 62 is turned on, the movable valve disc 64 is displaced in the upward direction as seen in FIG. 1 by the effect of a magnetic attractive force. At this time, a valve portion 70 of the movable valve disc 64 is brought into close contact with the stator 63, whereby the pressure control chamber 18 is isolated from the fuel passageway 40. At the same time, the movable valve disc 64 is released from the valve seat 68, and thus the pressure control chamber 18 is exposed to an environmental atmosphere via the atmosphere communication passageway 69.

The common rail 41 leads to a cylinder 46 in the fuel injection pump 45 via a discharge passageway 43, and the cylinder 46 leads to a fuel tank 50 via a fuel supply passageway 49 and a fuel pump 53. A piston 47 is slidably received in the cylinder 46 so that a fuel is pumped to the common rail 41 as the piston 47 reciprocably moves in the cylinder 46. In addition, the fuel pressure control unit 35 is provided with a fuel return passageway 51 which connects the discharge passageway 43 to the fuel supply passageway 49. A discharged fuel quantity control valve 52 is disposed in the fuel return passageway 51. When the discharged fuel quantity control valve 52 is open, a fuel discharged from the cylinder 46 is returned to the fuel supply passageway 49 via the fuel return passageway 51, and when the discharged fuel quantity control valve 52 is closed, a fuel discharged from the cylinder 46 is squeezed in the common rail 41, and thus a fuel pressure in the common rail 41 is immediately raised. Therefore, the fuel pressure P in the common rail 41 can be varied with a good responsiveness by properly controlling the time for which the discharged fuel quantity control valve 52 is kept open during a compression stroke of the piston 47.

Figure 2:
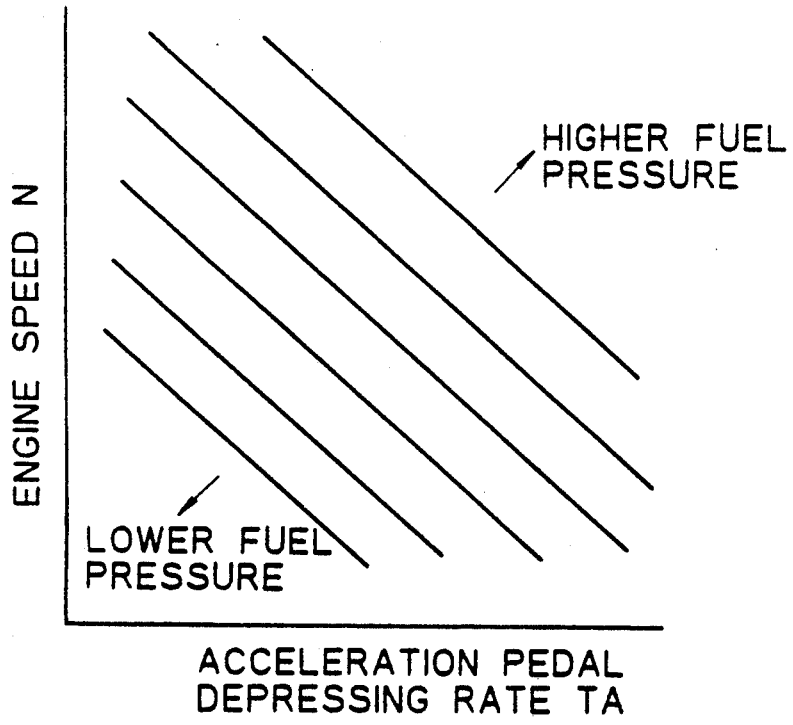
FIG. 2 is a diagram illustrating a relationship between an acceleration pedal depressing rate and an engine speed.

The fuel pressure P in the common rail 41 is controlled in accordance with an acceleration pedal depressing rate TA and an engine speed N. FIG. 2 shows a target fuel pressure $P_0$ of the fuel pressure P in the common rail 41, wherein group of curves represents a curve along which the target fuel pressure $P_0$ is kept constant, respectively. As apparent from FIG. 2, the larger the acceleration pedal depressing rate TA, the higher the target fuel pressure $P_0$. Also, the larger the engine speed N, the higher the target fuel pressure $P_0$. It should be noted that, in the map shown in FIG. 2, an upper limit value of the target fuel pressure $P_0$ is set to, e.g., about 1300 kg/cm$^2$ and a lower limit value of the same is set to, e.g., about 170 kg/cm$^2$.

A control circuit 60 calculates the target fuel pressure $P_0$ based on the acceleration pedal depressing rate TA detected by an acceleration pedal depressing rate sensor 57 and the engine speed N detected by an engine speed sensor 58, with reference to the map shown in FIG. 2. Further, the control circuit 60 performs a feedback control operation for the time for which the discharge fuel quantity control valve 52 is kept open, to allow the fuel pressure P in the common rail 41 detected by a pressure sensor 55 to coincide with the target fuel pressure $P_0$. Also, the solenoid valve 30 performs a shift operation in response to an output signal from the control circuit 60. Accordingly, the control circuit 60 performs a control operation such that the fuel pressure P in the common rail 41 coincides with the target fuel pressure $P_0$ shown in FIG. 2 by properly controlling the ON/OFF state of the discharge fuel quantity control valve 52. While the solenoid valve 30 is held at the position shown in FIG. 1, a fuel having a fuel pressure equal to the fuel pressure P in the common rail 41 is supplied to the pressure control chamber 18.

Next, the operation of the fuel injector constructed in accordance with the embodiment of the present invention will be described below with reference to FIG. 1 and FIG. 3.

While the pressure control chamber 18 is communicated with the fuel passageway 40 by a shift operation performed by the solenoid valve 30, the fuel pressure in the pressure chamber 17, the pressure control chamber 18 and the fuel chamber 7 is made equal to the fuel pressure P in the common rail 41. The pressure receiving area of the rear surface of the piston 12 is larger than that of the pressure receiving portion 6 of the needle 4, and thus the force for displacing the needle 4 downward direction exceeds the force for displacing same upward, and thus the valve portion 5 of the needle 4 is brought into close contact with the nozzle seat 3 of the nozzle main body 1, and as a result, the needle 4 is closed.

The following description encompasses a case wherein the fuel pressure P in the common rail 41, i.e., the fuel pressure in the pressure chamber 17 is lower than the valve-opening pressure in the opening and closing valve 29.

When the pressure control chamber 18 is exposed to an environmental atmosphere by a shift operation performed by the solenoid valve 30, the fuel pressure in the pressure control chamber 18 is immediately reduced to an atmospheric pressure. At this time, since the fuel pressure in the pressure chamber 17 is lower than the valve-opening pressure in the opening and closing valve 29, the opening and closing valve 29 is kept closed, and the orifice valve disc 23 is brought into close contact with the valve disc 21 by the resilient force of the compression spring 22, and therefore, a fuel in the pressure chamber 17 gradually flows into the pressure control chamber 18 via the restricted opening 25, causing the fuel pressure in the pressure chamber 17 to be gradually reduced, and thus the needle 4 is gradually opened. Consequently, as shown in FIG. 3(A), a fuel injection rate is gradually increased after the solenoid valve 30 is turned ON.

Figure 3A:
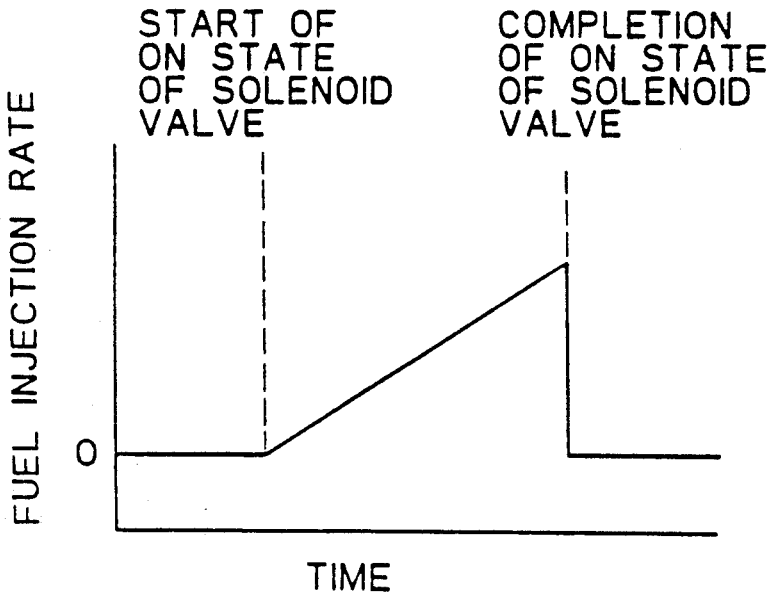
FIG. 3(A) and FIG. 3(B) are diagrams showing a fuel injection rate pattern with respect to the fuel injector in FIG. 1, respectively.

Subsequently, when the pressure control chamber 18 is communicated with the fuel passageway 40 by a shift operation performed by the solenoid valve 30, fuel in the common rail 41 is supplied to the pressure control chamber 18 via the fuel passageway 40, whereby the fuel pressure in the pressure control chamber 18 is immediately made equal to the fuel pressure in the common rail 41. Accordingly, when the fuel pressure in the pressure control chamber 18 is raised, the check valve 28 is immediately opened and the fuel pressure in the pressure chamber 17 is immediately made equal to the fuel pressure P in the common rail 41, and as a result, the needle valve 4 is quickly closed and a fuel injection is immediately interrupted, as shown in FIG. 3(A), whereby a good fuel injection stop can be obtained.

Where the fuel pressure P in the common rail 41 is lower than the valve-opening pressure in the opening and closing valve 29, as described above, a fuel injection pattern wherein a rise of the fuel injection rate is slow but a lowering of the same is rapid, as shown in FIG. 3(A), can be obtained.

The following description encompasses a case wherein the fuel pressure P in the common rail 41 is higher than the valve-opening pressure in the opening and closing valve 29.

Figure 3B:
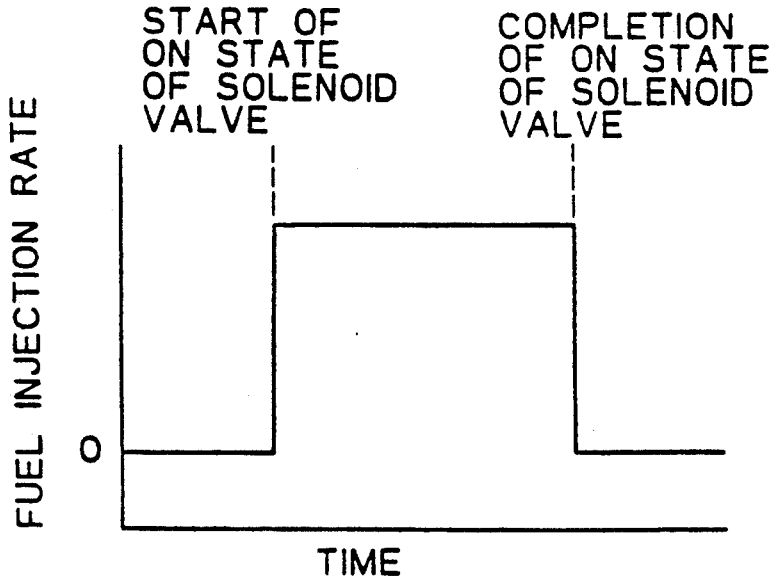

In this case, when the pressure control chamber 18 is exposed to the environmental atmosphere by a shift operation performed by the solenoid valve 30, the valve disc 21 is moved upward away from the bottom wall surface of the pressure control chamber 18, and therefore the opening and closing valve 29 is opened. Accordingly, the fuel in the pressure chamber 17 flows into the pressure control chamber 18 via the opening and closing valve 29 within a very short time, whereby the fuel pressure in the pressure chamber 17 is rapidly reduced, and as a result, the needle 4 is immediately raised by a maximum quantity of lift and a fuel injection rate is rapidly increased immediately after the solenoid valve 30 is turned ON, as shown in FIG. 3(B). Then, when the fuel pressure in the pressure chamber 17 is reduced, the opening and closing valve 29 is again closed.

Subsequently, when the pressure control chamber 18 is communicated with the fuel passageway 40 by a shift operation performed by the solenoid valve 30, a fuel in the common rail 41 is immediately introduced into the pressure control chamber 18 via the fuel passageway 40, whereby the check valve 28 is opened, and thus the fuel injection is immediately interrupted as in the case shown in FIG. 3(A).

Where the fuel pressure P in the common rail 41 is higher than the valve-opening pressure in the opening and closing valve 29 as described above, a pattern representing the fuel injection rate having not only a quick rise but also a quick lowering of the fuel injection rate, as shown in FIG. 3(B), can be obtained.

Figure 4:
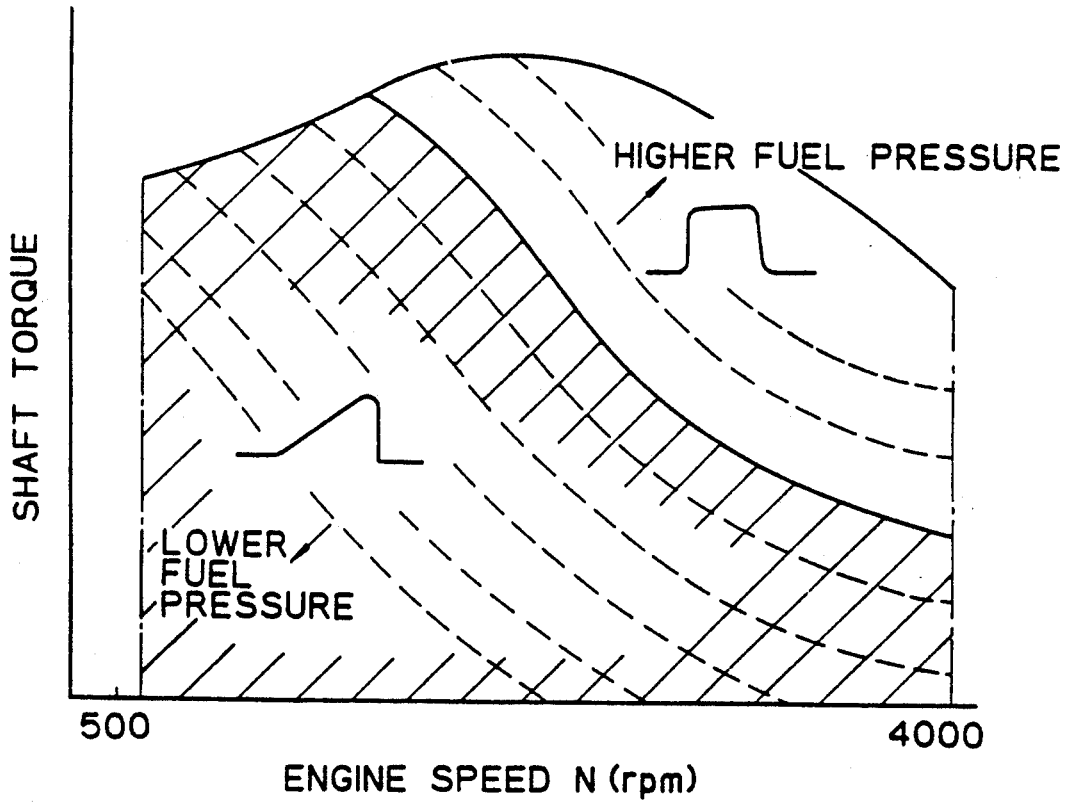
FIG. 4 is a diagram showing a fuel injection rate pattern representing a relationship to an engine speed and a torque appearing on an engine shaft.

FIG. 4 shows the fuel injection rate pattern derived from the fuel injector in accordance with the embodiment of the present invention, and particularly, illustrates a relationship between an engine speed and a torque at an engine shaft. A plurality of curves each represented by a dotted line in FIG. 4 show a curve along which the fuel pressure P in the common rail 41 is kept constant, respectively. These curves correspond to those in FIG. 2, and as shown, the higher the engine speed, the higher the fuel pressure P, and further, the larger the engine shaft torque, the higher the fuel pressure P.

As apparent from FIG. 4, according to the embodiment of the present invention, the fuel injection rate pattern having quick rise fuel injection rate as shown in FIG. 3(B) can be obtained within the operational range at which the engine operates at a high engine speed with a large engine shaft torque. In this case, a large quantity of fuel can be supplied to each combustion chamber in the engine within a short time, and thus the engine can output a required high engine power. Also, the fuel injection rate pattern having a gradual rise fuel injection rate, as shown in FIG. 3(A), can be obtained within the operational range at which the engine does not operate at a high speed or the engine does not operate with a large engine shaft torque. In this case, after the fuel is ignited while a small quantity of fuel is supplied to each combustion chamber in the engine through the fuel injector, the quantity of fuel to be supplied into the combustion chamber is gradually increased, and the fuel is successively ignited as it is injected into the combustion chamber. Therefore, the combustion pressure is smoothly raised, and thus noise generated by the combustion can be substantially attenuated.

According to the embodiment of the present invention, the restricted opening 25, the check valve 28 and the opening and closing valve 29 are arranged in parallel to each other from the viewpoint of function, but in practice, they are arranged in a serial relationship from the viewpoint of structure. Nevertheless, the present invention should not be limited to only the foregoing arrangement, as alternatively, the restricted opening 25, the check valve 28 and the opening and closing valve 29 may be arranged in a parallel relationship from the viewpoint of structure. Also, a plate valve type, a poppet valve type or the like may be employed as the valve disc 21.

As apparent from the above description, according to the present invention, where a fuel pressure in the pressure chamber is lower than a predetermined second pressure when the fuel pressure in the pressure control chamber is reduced by the fuel pressure control unit, the fuel injection rate is gradually raised, and accordingly, the combustion pressure in each combustion chamber of the engine is smoothly raised, whereby noise generated by the combustion in the engine can be effectively attenuated. Also, where the fuel pressure in the pressure chamber is lower than the predetermined second pressure, the fuel injection rate is quickly raised, resulting in a high engine output from the engine.

Although the invention has been described with reference to a specific embodiment chosen for purposes of illustration, it should be apparent that numerous modifications can be made thereto by those skilled in the art without departing from the basic concept and scope of the invention.

I claim:

1. A fuel injector including a needle and a pressure chamber defined by the rear surface of said needle, said needle being closed when a fuel pressure in said pressure chamber is raised, and said needle being opened when a fuel pressure in said pressure chamber is lowered, said fuel injector comprising:

a pressure control chamber formed in a region adjacent to said pressure chamber;

a restricted opening arranged between said pressure chamber and said pressure control chamber;

a valve which opens when the pressure in said pressure control chamber exceeds the pressure in said pressure chamber by a predetermined amount, such that, when open, said valve permits fuel to flow from the pressure control chamber to the pressure chamber;

an opening and closing valve which is opened when a fuel pressure in the pressure control chamber becomes lower than a fuel pressure in the pressure chamber by a predetermined first pressure, said restricted opening, said valve and said opening and closing valve being arranged between said pressure chamber and said pressure control chamber; and fuel pressure controlling means for controlling a fuel pressure in said pressure control chamber, said fuel pressure controlling means raising the fuel pressure in the pressure control chamber to introduce fuel in the pressure control chamber into the pressure chamber via the valve, said fuel pressure controlling means lowering the fuel pressure in the pressure control chamber to discharge fuel in the pressure chamber into the pressure control chamber via the restricted opening when the fuel pressure in the pressure chamber is lower than a predetermined second pressure and to discharge the fuel in the pressure chamber into the pressure control chamber via the opening and closing valve when the fuel pressure in the pressure chamber is higher than said predetermined second pressure.

2. A fuel injector as claimed in claim 1, wherein said fuel pressure controlling means includes a fuel injection pump, a solenoid valve disposed in a fuel passageway by way of which said fuel injection pump is connected to the pressure control chamber, said solenoid valve being communicated with an environmental atmosphere, and fuel pressure varying means for varying a fuel pressure in said fuel passageway upstream of said solenoid valve.

3. A fuel injector as claimed in claim 1, wherein said fuel pressure controlling means includes a fuel injection pump, a common rail in which the fuel discharged from said fuel injection pump is stored, fuel pressure varying means for varying a fuel pressure in said common rail, and a solenoid valve disposed in the fuel passageway for connecting said common rail to the pressure chamber, said solenoid valve being able to communicate with an environmental atmosphere.

4. A fuel injector as claimed in claim 3, wherein said fuel pressure varying means includes a fuel return passageway branched from a discharge passageway through which the fuel injection pump is connected to the common rail, and a discharged fuel quantity control valve for controlling a quantity of fuel discharged from the fuel injection pump into the common rail via said discharge passageway, said fuel pressure varying means performing a control operation such that a valve-opening time of said discharged fuel quantity control valve during a compression stroke of the fuel injection pump is controlled to thereby allow a fuel pressure in the common rail to be made equal to a predetermined target fuel pressure, depending on the operational state of an engine.

5. A fuel injector as claimed in claim 4, wherein said discharged fuel quantity control valve is disposed in said fuel return passageway.

6. A fuel injector as claimed in claim 4, wherein said fuel pressure varying means further includes pressure detecting means for detecting a fuel pressure in the common rail such that a feedback control operation is performed for the valve-opening time of said discharged fuel quantity control valve during a compression stroke of the fuel injection pump, to thereby allow the fuel pressure in the common rail detected by said pressure detecting means to be made equal to said target fuel pressure.

7. A fuel injector as claimed in claim 3, wherein said fuel passageway connects the common rail to a fuel chamber adapted to be communicated with a nozzle in the fuel injector, when the fuel injector is opened.

8. A fuel injector as claim in claim 2 or claim 3, wherein said solenoid valve includes an exciting coil, a stator disposed in a casing, a movable hollow valve disc slidably disposed between the inner peripheral wall surface of said casing and the outer peripheral wall surface of said stator to slidably move along an axis line of said stator, said movable valve disc extending outward of the foremost end surface of the stator, biasing means for bringing the movable valve disc into close contact with a valve seat on the inner peripheral wall surface of the casing when said exciting coil is turned off, a valve portion on the inner peripheral wall surface of the movable valve disc adapted to be brought into close contact with the foremost end surface of the stator when the exciting coil is turned on, a passageway in the movable valve disc formed by the inner peripheral wall surface of the movable valve disc and the foremost end surface of the stator, said passageway being communicated with the pressure control chamber, a fuel passageway portion formed in the peripheral wall of the casing while forming a part of the fuel passageway, a communication hole formed in the peripheral wall of the movable valve disc to thereby allow a passageway in the movable valve disc to be communicated with said fuel passageway portion when the movable disc is brought into close contact with the valve seat, and an atmosphere communication passageway formed on the peripheral wall of the casing to thereby allow said passageway in the movable valve disc to be communicated with an environmental atmosphere when said valve portion on the inner peripheral wall surface of the movable valve disc is brought into close contact with the foremost end surface of the stator, said solenoid valve being operated in such a manner that, when the exciting coil is turned off the movable valve disc is brought into close contact with the valve seat, whereby the pressure control chamber is communicated with the fuel passageway via said passageway in the movable valve disc and said communication hole while the pressure control chamber is kept closed and isolated from said atmosphere communication passageway, and when the exciting coil is turned on, the valve portion on the inner peripheral wall surface of the movable valve disc is brought into close contact with the foremost end surface of the stator, whereby the pressure control chamber is kept closed and isolated from the fuel passageway while the pressure control chamber is communicated with the atmosphere communication passageway.

9. A fuel injector as claimed in claim 1, wherein said restricted opening, said valve and said opening and closing valve are arranged in parallel each other from the viewpoint of function and are arranged in series from the viewpoint of structure.

10. A fuel injector as claimed in claim 1, wherein said restricted opening, said valve and said opening and closing valve are arranged in parallel to each other from the viewpoint of function and from the viewpoint of structure.

11. A fuel injector as claimed in claim 9, wherein said pressure chamber is opened to the pressure control chamber at the central part of the bottom wall surface thereof, said opening and closing valve is composed of a valve disc disposed in the pressure control chamber and a compression spring for bringing said valve disc into close contact with the bottom wall surface of the pressure control chamber, to thereby allow an opening portion of the pressure chamber to be closed with said valve disc, said valve is composed of a through hole formed on said valve disc, an orifice valve disc disposed in the pressure chamber and a compression spring for biasing said orifice valve disc toward said valve disc, to thereby allow said through hole to be closed by said orifice valve disc, said restricted opening being formed such that it is aligned with said through hole at the central part of the orifice valve disc.

12. A fuel injector as claimed in claim 1, wherein while an engine operates within the operational range having a high engine speed and a large magnitude of torque appearing on an engine shaft, said fuel pressure control means performs a control operation such that the fuel pressure in the pressure chamber is higher than said predetermined second pressure when the fuel pressure in the pressure control chamber is lowered by said fuel pressure controlling means, and while the engine operates within an operational range not at a high engine speed or not having a large torque at the engine shaft, said fuel pressure control means performs a control operation such that the fuel pressure in the pressure chamber is lower than said predetermined second pressure when the fuel pressure in the pressure control chamber is lowered by said fuel pressure control means.

* * * * *

UNITED STATES PATENT AND TRADEMARK OFFICE

CERTIFICATE OF CORRECTION

PATENT NO. : 5,176,120

DATED : January 5, 1993

INVENTOR(S) : Takeshi TAKAHASHI

It is certified that error appears in the above-identified patent and that said Letters Patent is hereby corrected as shown below:

Column 1, lines 15 and 16, change "flow out" to --outflow--.

Column 1, line 40, between "chamber" and "a" insert --in--.

Column 4, line 38, between "wherein" and "group" insert --a--.

Column 5, line 13, before "down-" insert --in a--.

Column 8, line 50, change "A fuel injector as claim" to --A fuel injector as claimed--.

Column 9, line 33, between "parallel" and "each" insert --to--.

Signed and Sealed this

Fourteenth Day of December, 1993

*Attest:*

Bruce Lehman

BRUCE LEHMAN

*Attesting Officer*

*Commissioner of Patents and Trademarks*